US009211222B2

(12) United States Patent
Olst et al.

(10) Patent No.: US 9,211,222 B2
(45) Date of Patent: Dec. 15, 2015

(54) SEAT MECHANISM OF ELECTRIC WHEELCHAIR

(71) Applicant: KARMA MEDICAL PRODUCTS CO., LTD., Minsyong Township, Chiayi County (TW)

(72) Inventors: Eric Van Olst, Denekamp (NL); Chih-Chuan Yang, Minsyong Township, Chiayi County (TW); Cheng-Jy Tien, Minsyong Township, Chiayi County (TW)

(73) Assignee: KARMA MEDICAL PRODUCTS CO., LTD., Chiayi County (TW)

( * ) Notice: Subject to any disclaimer, the term of this patent is extended or adjusted under 35 U.S.C. 154(b) by 0 days.

(21) Appl. No.: 14/583,397

(22) Filed: Dec. 26, 2014

(65) Prior Publication Data

US 2015/0202103 A1 Jul. 23, 2015

(30) Foreign Application Priority Data

Jan. 22, 2014 (TW) ..... 103201330 A

(51) Int. Cl.

| | |
|---|---|
| ***A61G 5/10*** | (2006.01) |
| ***A61G 5/12*** | (2006.01) |
| ***A61G 5/04*** | (2013.01) |

(52) U.S. Cl.

CPC ..... *A61G 5/1062* (2013.01); *A61G 5/04* (2013.01); *A61G 5/1064* (2013.01); *A61G 5/12* (2013.01); *A61G 2005/127* (2013.01); *A61G 2005/128* (2013.01)

(58) Field of Classification Search

CPC ..... A61G 5/1062; A61G 5/12; A61G 5/04; A61G 5/1064; A61G 2005/127; A61G 2005/128

See application file for complete search history.

(56) References Cited

U.S. PATENT DOCUMENTS

| | | | | |
|---|---|---|---|---|
| 5,564,786 | A * | 10/1996 | Peek | A61G 5/10 280/250.1 |
| 5,954,402 | A * | 9/1999 | McInturff | A61G 5/1062 297/440.22 |
| 5,984,418 | A * | 11/1999 | McInturff | A61G 5/1062 248/298.1 |
| 6,352,307 | B1 * | 3/2002 | Engman | A61G 5/1059 297/284.1 |
| 6,913,318 | B2 * | 7/2005 | Higley | A61G 5/1067 297/383 |

(Continued)

FOREIGN PATENT DOCUMENTS

| | | | | |
|---|---|---|---|---|
| EP | 2898866 | A1 * | 7/2015 | A61G 5/04 |

OTHER PUBLICATIONS

Selected documents from the prosecution history of corresponding European Application No. 14275244.3 mailed in 2015 (5 pages).*

*Primary Examiner* — Rodney Mintz

(74) *Attorney, Agent, or Firm* — Muncy, Geissler, Olds & Lowe P.C.

(57) ABSTRACT

A seat mechanism includes a front seat plate, left and right guide rails each having a longitudinal rail groove, a rear seat plate disposed on the guide rails, two protruding rods each protruding downward from a bottom surface of the rear seat plate to a corresponding guide rail, a plurality of guide members projecting sideward from each protruding rod and inserted into the rail groove of the corresponding guide rail such that each guide rail is slidable relative to the guide members of the corresponding protruding rod, and a plurality of fasteners each extending through the rear seat plate and detachably and selectively engaging one positioning hole in the guide rails for adjustably positioning the rear seat plate on the guide rails.

16 Claims, 14 Drawing Sheets

(56) References Cited

U.S. PATENT DOCUMENTS 8,449,032 B2 * 5/2013 Serhan ..... A61G 5/1064 297/284.11
8,801,638 B2 * 8/2014 Gierse ..... A61G 5/14 297/145
2004/0104614 A1 * 6/2004 Higley ..... A61G 5/1067 297/452.4
2004/0189076 A1 * 9/2004 Hanson ..... A61G 5/1067 297/440.15
2006/0021142 A1 * 2/2006 Hornbach ..... A47C 19/045 5/600
2011/0084528 A1 * 4/2011 Gierse ..... A61G 5/14 297/313
2011/0291381 A1 * 12/2011 Serhan ..... A61G 5/1064 280/250.1
2013/0257021 A1 * 10/2013 Ciolfe ..... A61G 5/1059 280/657

* cited by examiner

SEAT MECHANISM OF ELECTRIC WHEELCHAIR

CROSS REFERENCE TO RELATED APPLICATION

This application claims priority of Taiwanese Patent Application No. 103201330, filed on Jan. 22, 2014.

FIELD OF THE INVENTION

The invention relates to a seat mechanism, more particularly to a seat mechanism of an electric wheelchair.

BACKGROUND OF THE INVENTION

Following the advancement of technology, the control functions of the electric wheelchair are becoming more and more advanced, so that the electric wheelchair is an indispensable means of transport for many elderly people and people with mobility impairments. However, an existing electric wheelchair is produced by assembling together molded components of fixed specifications. As such, the front-rear length and the left-right width of the seat of the existing electric wheelchair are fixed and cannot be altered. If a user requires a longer or wider seat, the entire seat mechanism must be removed and replaced with a custom-made seat mechanism having special specifications. Thus, the existing electric wheelchair is quite inconvenient to use, and the user's purchase cost is increased.

SUMMARY OF THE INVENTION

Therefore, an object of the present invention is to provide a seat mechanism of an electric wheelchair that is capable of overcoming the aforementioned drawbacks of the prior art.

Accordingly, a seat mechanism of an electric wheelchair includes a front seat plate unit and a rear seat plate unit. The front seat plate unit includes a front seat plate having front and rear ends that are opposite to each other along a front-rear direction of the electric wheelchair, and left and right guide rails that are elongated in the front-rear direction, that are spaced apart from each other in a left-right direction of the electric wheelchair, that are connected to a bottom surface of the front seat plate, and that extend rearwardly from the rear end of the front seat plate. Each of the left and right guide rails has left and right longitudinal surfaces, a top longitudinal surface interconnecting the left and right longitudinal surfaces, a longitudinal rail groove that is indented from at least one of the left and right longitudinal surfaces, and a plurality of positioning holes formed in the top longitudinal surface and longitudinally spaced apart from each other. The rear seat plate unit includes a rear seat plate positioned rearwardly of the rear end of the front seat plate and disposed on the left and right guide rails, two protruding rods each of which protrudes downward from a bottom surface of the rear seat plate to one side of a corresponding one of the left and right guide rails and is elongated in the front-rear direction, a plurality of guide members projecting sideward from each protruding rod and longitudinally spaced apart from each other, and a plurality of fasteners each of which extends through the rear seat plate and detachably and selectively engages one of the positioning holes in the left and right guide rails for adjustably positioning the rear seat plate on the left and right guide rails. The guide members of each protruding rod are inserted into the rail groove of a corresponding one of the left and right guide rails, such that each of the left and right guide rails straddles and is slidable relative to the guide members of a corresponding one of the protruding rods in the front-rear direction.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENT

Figure 1:
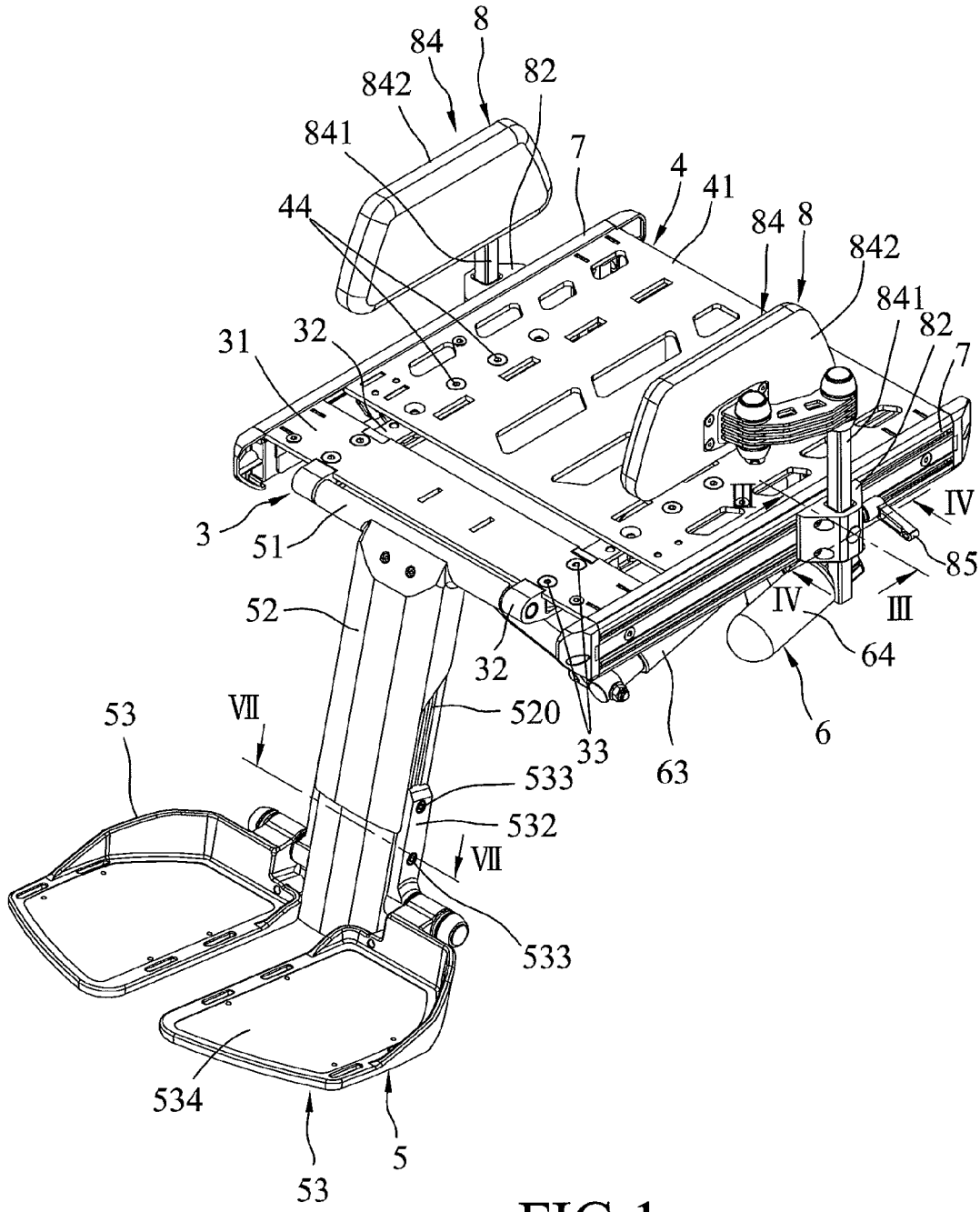
FIG. 1 is a perspective view of a seat mechanism of an electric wheelchair according to the first embodiment of the present invention.

Before the present invention is described in greater detail with reference to the accompanying embodiments, it should be noted herein that like elements are denoted by the same reference numerals throughout the disclosure.

Referring to FIGS. 1 to 9, a seat mechanism according to the first embodiment of the present invention is suitable for installation on a frame (not shown) of an electric wheelchair for a user to sit thereon. The seat mechanism includes a front seat plate unit 3, a rear seat plate unit 4, a footrest unit 5, an angle adjustment unit 6, left and right side bars 7, and two side block units 8.

The front seat plate unit 3 includes a front seat plate 31 having front and rear ends that are opposite to each other along a front-rear direction of the electric wheelchair, and left and right guide rails 32 that are elongated in the front-rear direction, that are spaced apart from each other in a left-right direction of the electric wheelchair, that are connected to a bottom surface of the front seat plate 31, and that extend rearwardly from the rear end of the front seat plate 31. The left and right guide rails 32 are fixed to the bottom surface of the front seat plate 31 using a plurality of fasteners 33. Each of the left and right guide rails 32 has left and right longitudinal surfaces 327, a top longitudinal surface 325 interconnecting the left and right longitudinal surfaces 327, a plurality of positioning holes 321 formed in the top longitudinal surface 325 and longitudinally spaced apart from each other, and a longitudinal rail groove 322 indented from each of the left and right longitudinal surfaces 327. The left guide rail 32 further has a mounting notch 323 in the top longitudinal surface 325 in proximity to a rear end thereof.

Figure 2:
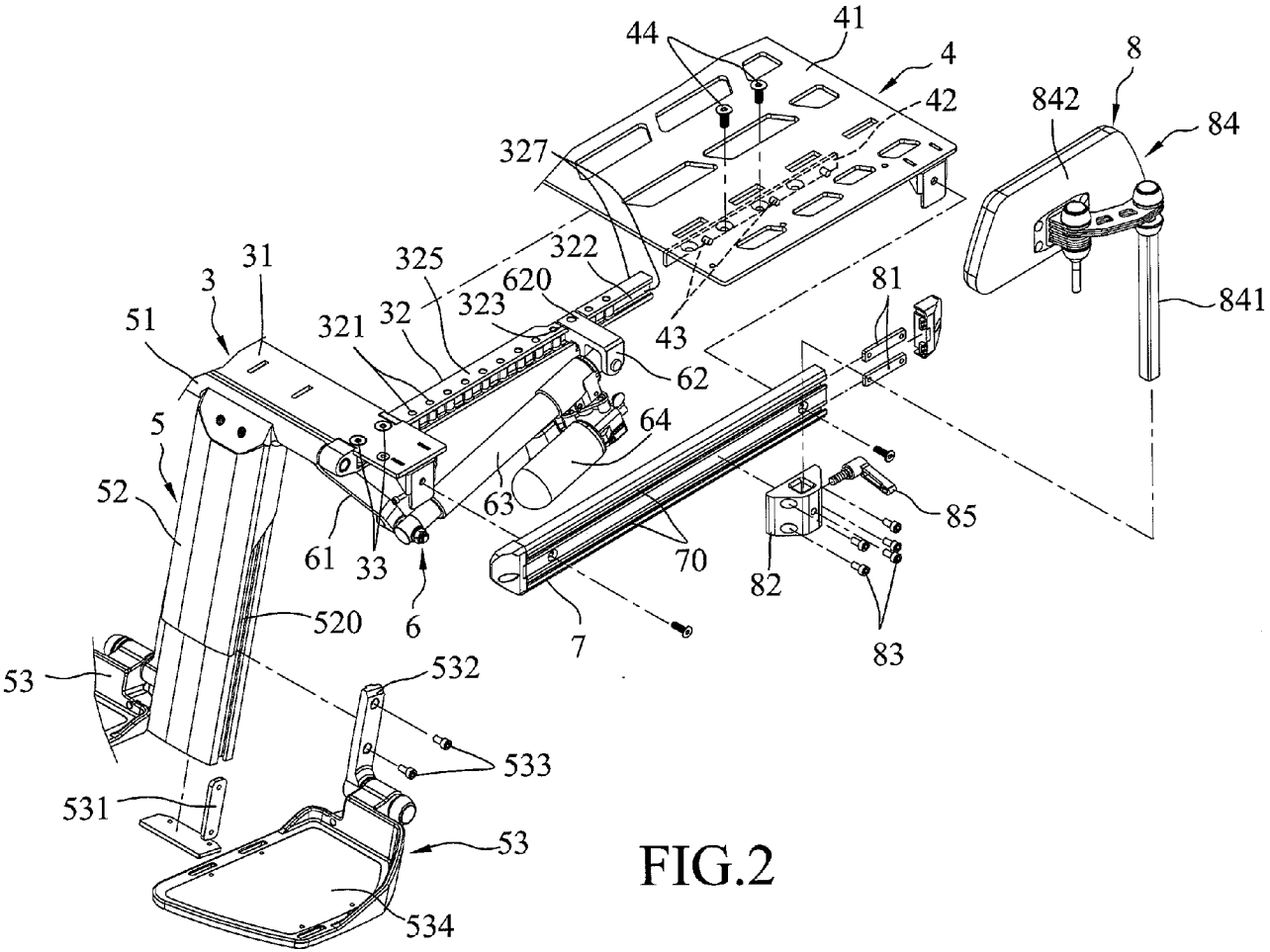
FIG. 2 is an exploded perspective view of the left side components of the first embodiment.

The rear seat plate unit 4 includes a rear seat plate 41 positioned rearwardly of the rear end of the front seat plate 31 and disposed on the top longitudinal surfaces 325 of the left and right guide rails 32, two protruding rods 42 (only one is shown in FIG. 2) each of which protrudes downward from a bottom surface of the rear seat plate 41 to one side of a corresponding one of the left and right guide rails 32 and is elongated in the front-rear direction, a plurality of guide members 43 projecting sideward from each of the protruding rods 42 and longitudinally spaced apart from each other, and a plurality of fasteners 44 each of which extends through a top surface of the rear seat plate 41 and detachably and selectively engaging one of the positioning holes 321 in the left and right guide rails 32.

The guide members 43 of each protruding rod 42 are inserted into the rail groove 322 of a corresponding one of the left and right guide rails 32, such that each of the left and right guide rails 32 straddles and is slidable relative to the guide members 43 of a corresponding protruding rod 42 in the front-rear direction. Further, the left and right guide rails 32 are driven by the front seat plate 31 to move forward and rearward relative to the rear seat plate 41. In this embodiment, each fastener 44 is detachably and threadedly engaged to the selected one of the positioning holes 321 in the left and right guide rails 32. Through this, the rear seat plate 41 can be adjustably positioned on the left and right guide rails 32.

Figure 4:
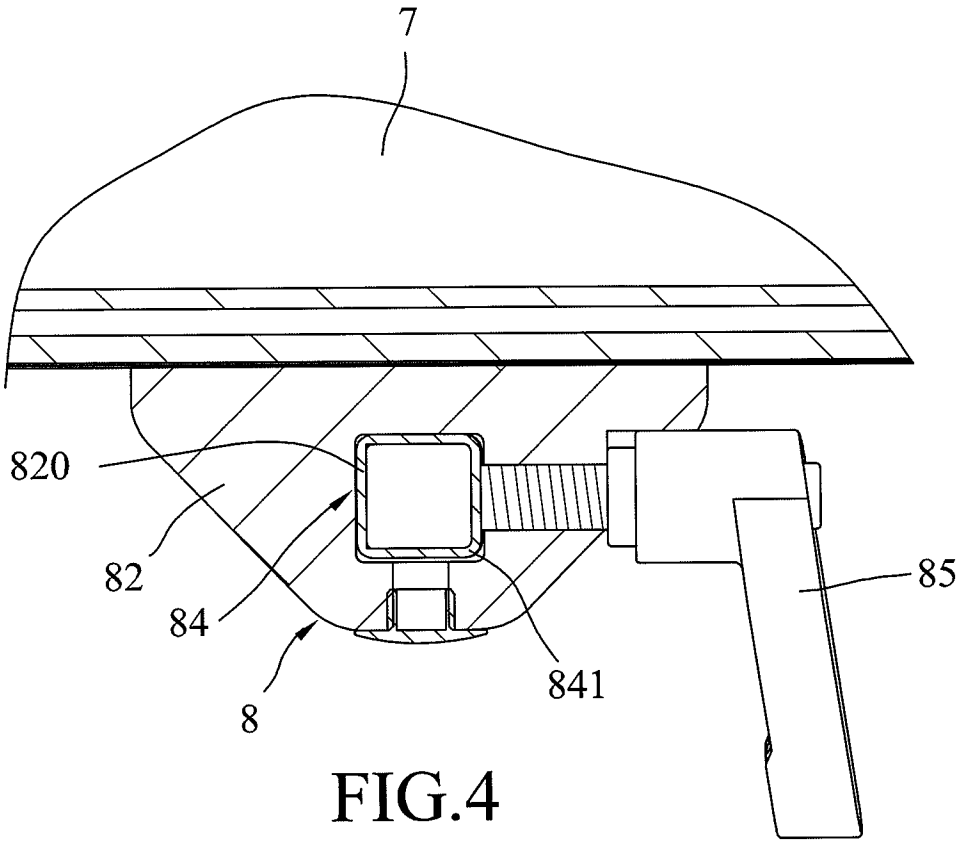
FIG. 4 is a sectional view of the first embodiment taken along line IV-IV of FIG. 1.

With reference to FIGS. 1, 2 and 4, the footrest unit 5 includes a cross bar 51 connected rotatably between front ends of the left and right guide rails 32 which are proximate to the front end of the front seat plate 31, a movable bar 52 fixed to and extending downwardly, forwardly and inclinedly from the crossbar 51, and two pedal modules 53 mounted to a bottom portion of the movable bar 52 and spaced apart from each other in the left-right direction.

The movable bar 52 has left and right surfaces, and two slide grooves 520 (only one of the slide grooves 520 is visible in FIGS. 1 and 5) respectively indented from the left and right surfaces thereof. Each of the slide grooves 520 has a dovetail cross section, and extends in a top-bottom direction along the length of the movable bar 52. Each of the pedal modules 53 is mounted to a respective one of the left and right surfaces of the movable bar 52, and is slidable upward and downward along the slide groove 520 thereof. Each pedal module 53 includes a slider 531 disposed in and slidable upward and downward along a respective one of the slide grooves 520, a mounting seat 532 disposed on an outer side of the respective left or right surface of the movable bar 52, two tightening members 533 threadedly connected to the slider 531 and the mounting seat 532 and operable to tighten or loosen the mounting seat 532 against or from the outer side of the respective left or right surface of the movable bar 52, and a pedal plate 534 pivoted to the mounting seat 532 and protruding forwardly of the movable bar 52.

To adjust a height of the pedal plate 534, the tightening members 533 are first threadedly loosened, after which the mounting seat 532 is moved upward or downward to a desired position. The pedal plate 534 and the slider 531 are driven by the mounting seat 532 to move therealong. When the desired height of the pedal plate 534 is reached, the tightening members 533 are then tightened, urging the slider 531 and the mounting seat 532 to move toward each other and to clamp therebetween the respective left or right surface of the movable bar 52. The height adjustment of the pedal plate 534 is thus completed.

Figure 5:
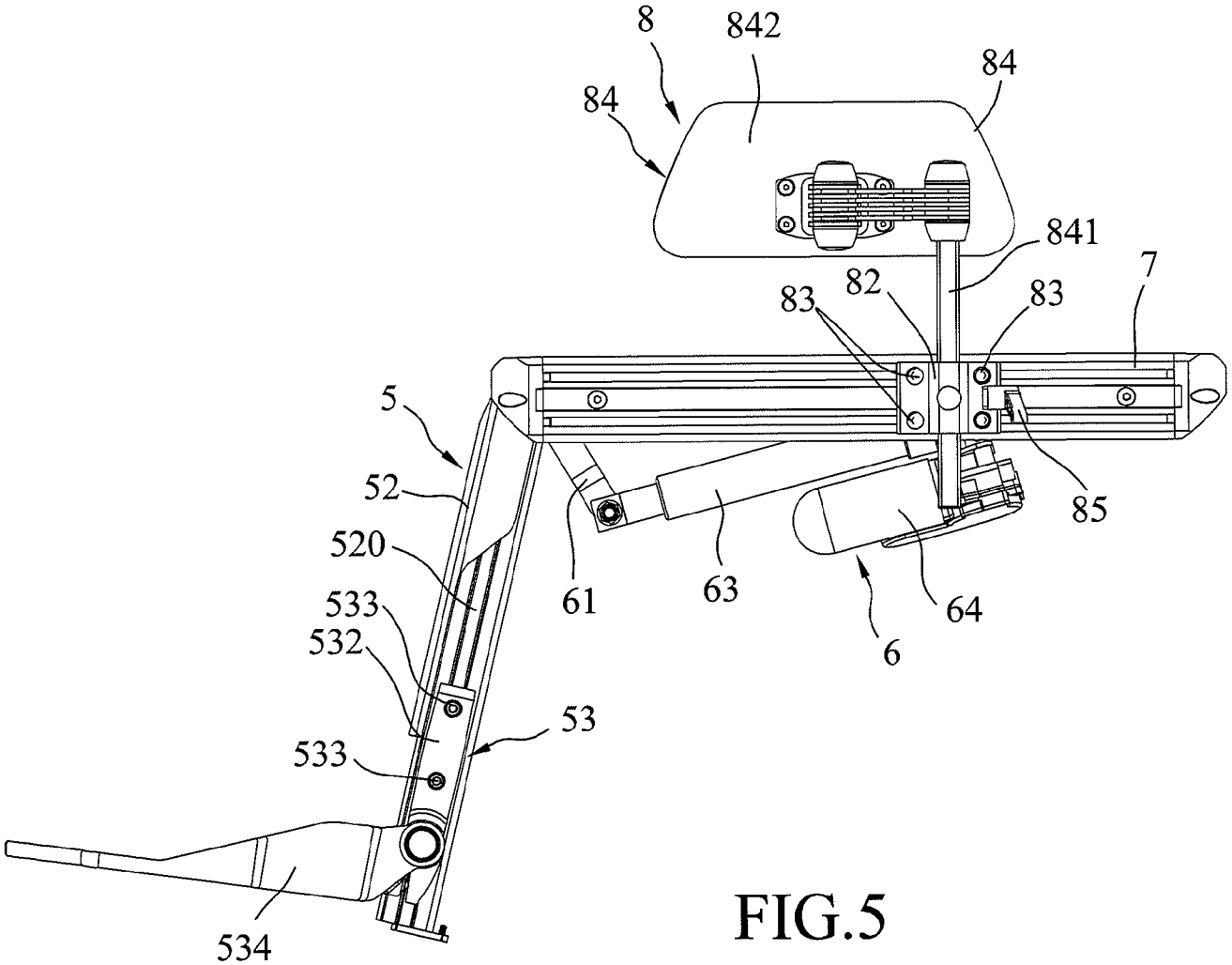
FIG. 5 is a schematic side view of the first embodiment.
Figure 6:
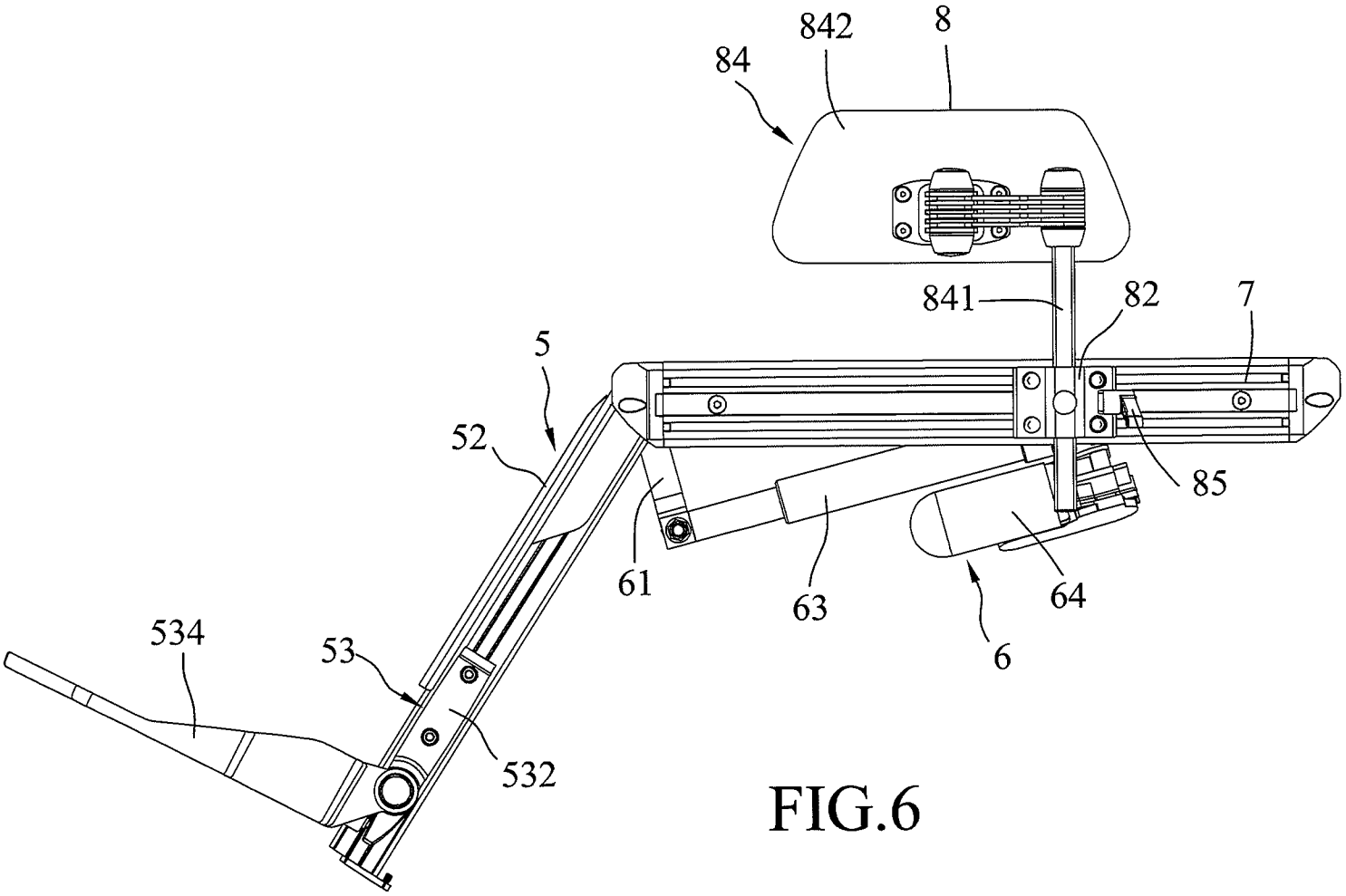
FIG. 6 is a view similar to FIG. 5, but with a footrest unit being moved to a different angle.

With reference to FIGS. 2, 5 and 6, the angle adjustment unit 6 is mounted between the cross bar 51 and the left guide rail 32, and includes a drive rod 61 fixed to and extending rearwardly, downwardly and inclinedly from the cross bar 51, a connecting seat 62 fixed to the mounting notch 323 of the left guide rail 32, a telescopic rod 63 pivoted between a bottom end of the drive rod 61 and the connecting seat 62, and an actuator 64 mounted to the telescopic rod 63. A top surface of the connecting seat 62 is flush with the top surface of the left guide rail 32, and has a positioning hole 620 aligned with the positioning holes 321 of the left guide rail 32. The positioning hole 620 is threadedly engagable with one of the fasteners 44.

In this embodiment, the actuator 64 is an electric motor, and is drivingly connected to the telescopic rod 63. The actuator 64 is operated to drive the telescopic rod 63 to extend or shorten the length thereof. When the telescopic rod 63 extends forward and becomes long, it will push forward the bottom end of the drive rod 61, and a top end of the drive rod 61 will drive the crossbar 51 to rotate, thereby driving the movable bar 52 to move forward.

Figure 3:
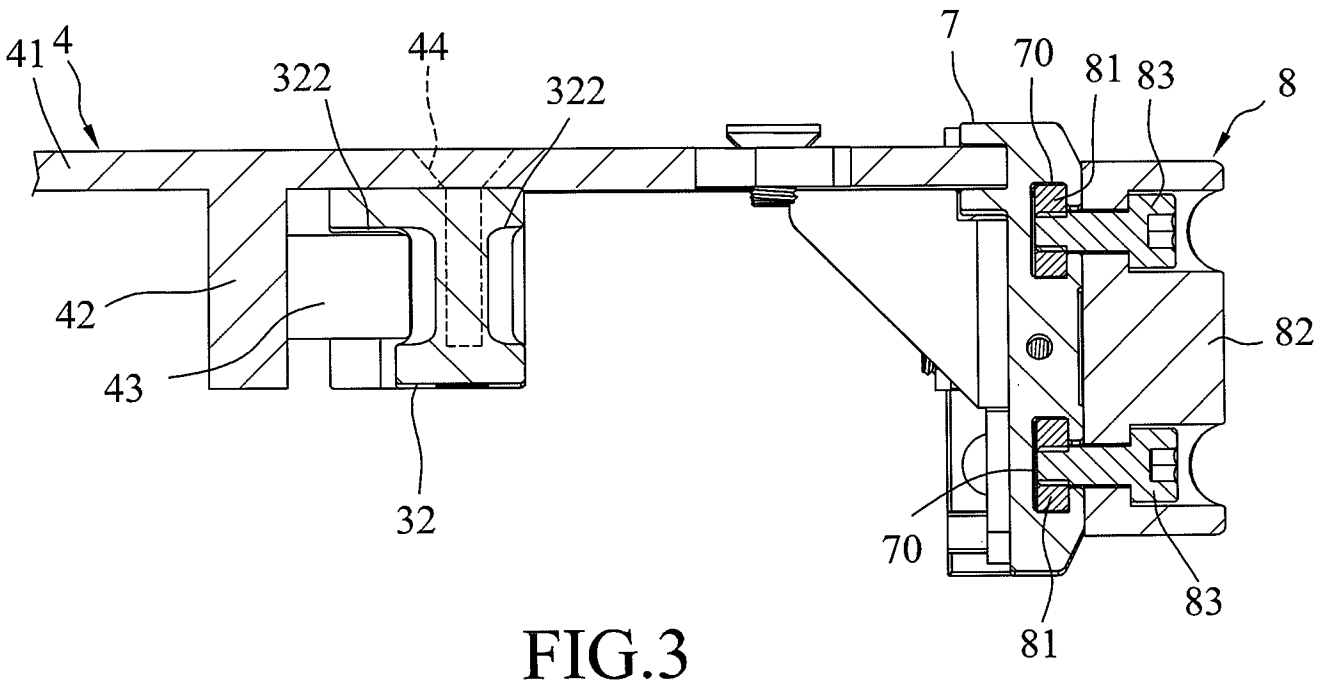
FIG. 3 is a sectional view of the first embodiment taken along line of FIG. 1.
Figure 7:
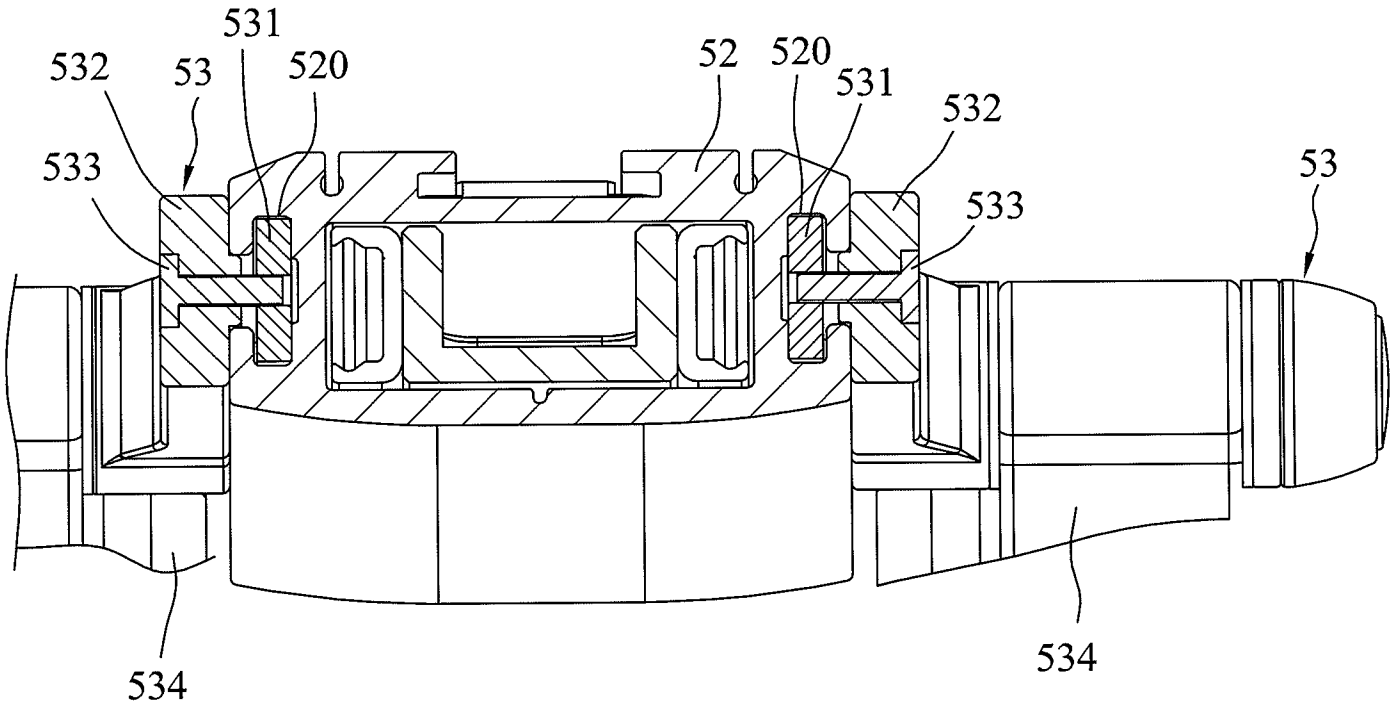
FIG. 7 is a sectional view of the first embodiment taken along line VII-VII of FIG. 1.

With reference to FIGS. 2, 3 and 7, the left and right side bars 7 are both elongated in the front-rear direction. The left sidebar 7 is fixed to the left sides of the front and rear seat plates 31, 41. The right side bar 7 is fixed to the right sides of the front and rear seat plates 31, 41. Each of the left and right side bars 7 has two parallel slide grooves 70 indented from an outer surface thereof, spaced apart from each other in the top-bottom direction and extending in the front-rear direction along the length thereof.

The side block units 8 are respectively mounted to the left and right side bars 7. Each side block unit 8 includes two sliders 81 respectively disposed in and slidable along the slide grooves 70 of a respective left or right side bar 7, an adapter 82 disposed on the outer surface of the respective left or right side bar 7, a plurality of fasteners 83 connected to the adapter 82 and the sliders 81 and operable to tighten or loosen the adapter 82 against or from the outer surface of the respective left or right side bar 7, a side block module 84 mounted to the adapter 82, and a lever handle 85 threadedly connected to the adapter 82 to adjustably position the side block module 84 on the adapter 82. The adapter 82 has an insertion hole 820 extending therethrough in the top-bottom direction. The side block module 84 includes a lift rod 841 movably inserted into the insertion hole 820, and a blocking plate 842 mounted to a top end of the lift rod 841 and pivotable leftward and rightward relative to the lift rod 841. The lever handle 85 is inserted into the insertion hole 820 in a transverse direction that is transverse to the top-bottom direction, and is operable to press tightly against the lift rod 841 so as to position the lift rod 841 on the adapter 82 or to move away from the lift rod 841 so as to permit upward and downward movement of the lift rod 841 relative to the adapter 82. Since the adjustment of the blocking plates 842 of the side block modules 84 of the side block units 8 are similar, only one of the blocking plates 842 of the side block modules 84 of the side block units 8 will be described hereinafter.

To adjust the position of the blocking plate 842, the fasteners 83 are first loosened, after which the adapter 82 is pushed forward or rearward relative to the side bar 7. The side block module 84 moves along with the adapter 82, and the sliders 81 are driven by the adapter 82 to slide forward or rearward along the slide grooves 70. When the desired position of the blocking plate 842 is reached, the fasteners 83 are then tightened, urging the sliders 81 and the adapter 82 to move toward each other and clamp against the side bar 7, thereby positioning the adapter 82 to the desired front/rear position. To adjust the height of the blocking plate 842, the lever handle 85 is rotated to move away from pressing against the lift rod 841, after which the lift rod 841 is moved upward or downward relative to the adapter 82. When the desired height of the blocking plate 842 is reached, the lever handle 85 is rotated to press tightly against the lift rod 841, thereby positioning the blocking plate 842 at the desired height.

With reference to FIGS. 1, 3 and 7, when the seat mechanism of this embodiment is assembled on the electric wheelchair, a soft seat cushion (not shown) is placed over the front and rear seat plates 31, 41. When adjustment of a front-to-rear length of a seat surface formed by the front and rear seat plates 31, 41 is required, the left and right side bars 7 are first detached, after which the fasteners 44 are removed from the left and right guide rails 32. The front seat plate unit 3 can then be pushed forward or pulled rearward relative to the rear seat plate unit 4 so as to move the left and right guide rails 32 forward or rearward relative to the guide members 43. When a suitable length of the seat surface of the seat mechanism is reached, the fasteners 44 are fastened back to the rear seat plate 41 and the left and right guide rails 32. Hence, adjustment of the front-to-rear length of the seat surface of the seat mechanism of this invention is completed. At this time, based on the adjusted front-to-rear length of the front and rear seat plates 31, 41 of the seat mechanism, new side bars 7 of suitable lengths are assembled, and the side block units 8 are mounted to the new side bars 7. Furthermore, if the spacing between the front and rear seat plates 31, 41 is large, another flat panel (not shown) may be placed on the top surfaces of the front and rear seat plates 31, 41 so as not to cause discomfort during use of the seat mechanism of this invention.

Figure 8:
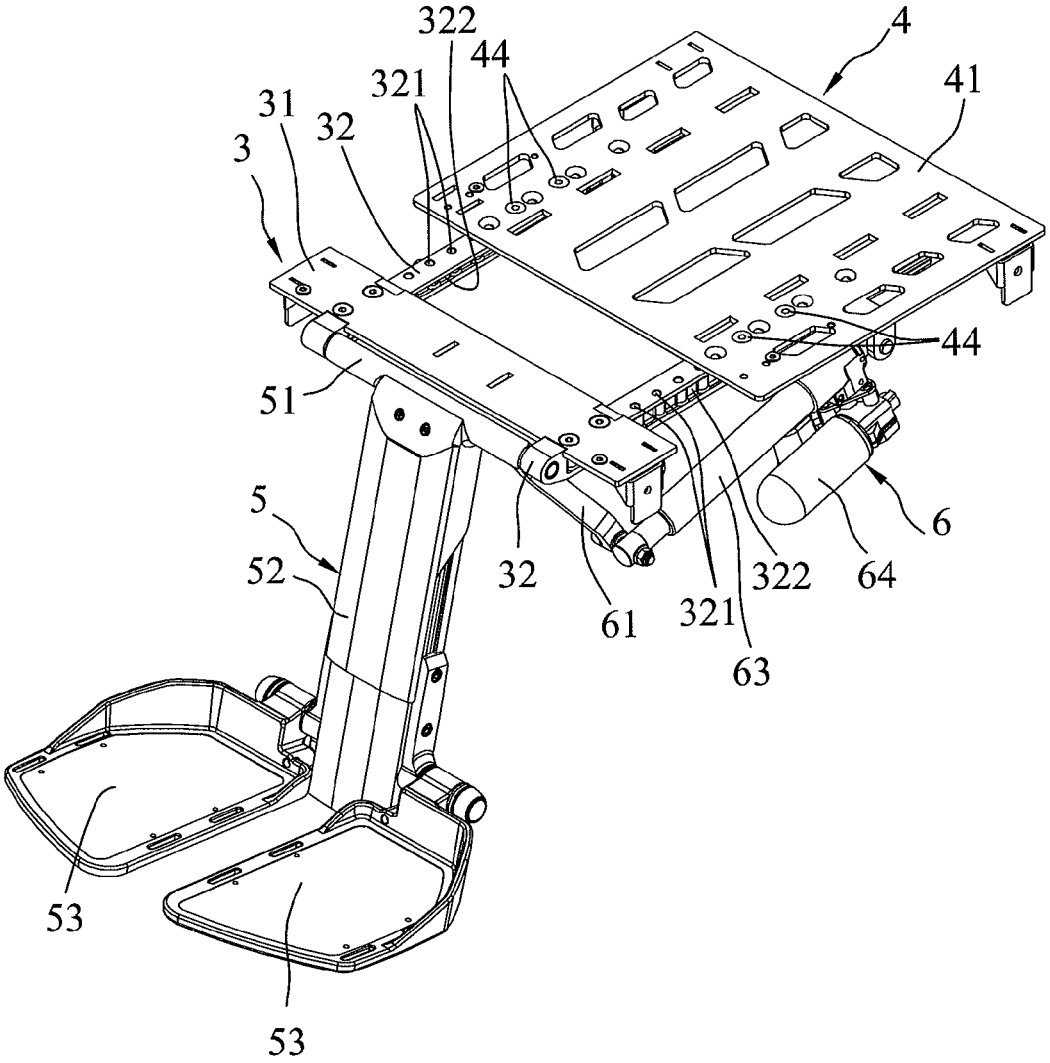
FIG. 8 is a partial perspective view of the first embodiment, illustrating a front seat plate unit being moved forward relative to a rear seat plate unit by a distance.
Figure 9:
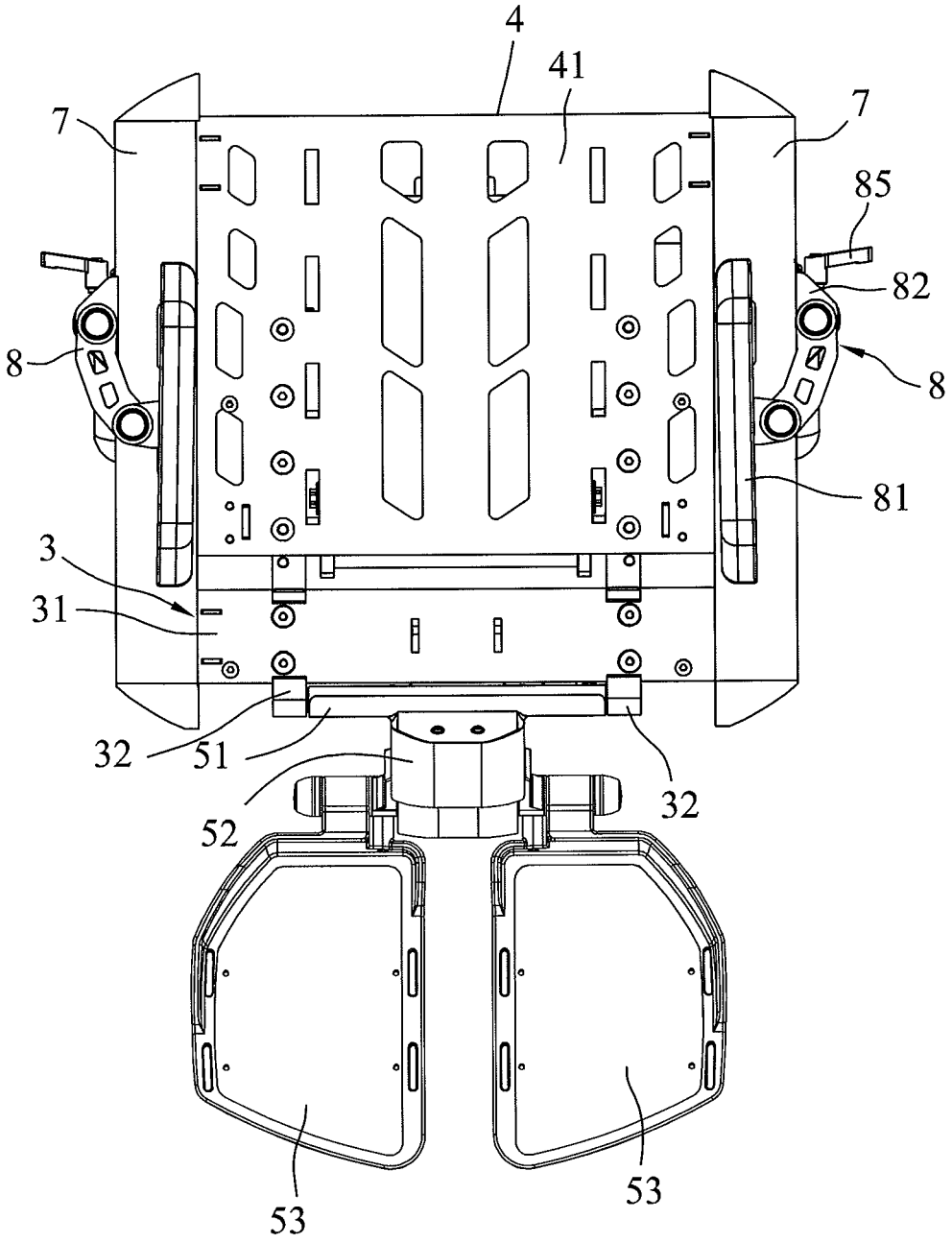
FIG. 9 is a schematic top view of the first embodiment.

With reference to FIG. 8, moreover, to adjust the left-to-right width of the seat surface formed by the front and rear seat plates 31, 41 of the seat mechanism, the originally used left and right side bars 7 are detached, and are replaced with new left and right side bars 7 having larger left-to-right widths. Afterwards, the side block units 8 are assembled to the new left and right side bars 7. Through this, the width of the seat surface formed by the front seat plate 31, the rear seat plate 41 and the new left and right side bars 7 is enlarged. However, in actual implementation, the adjustment of the width of the seat surface of the seat mechanism is not limited to the aforesaid disclosure.

Figure 10:
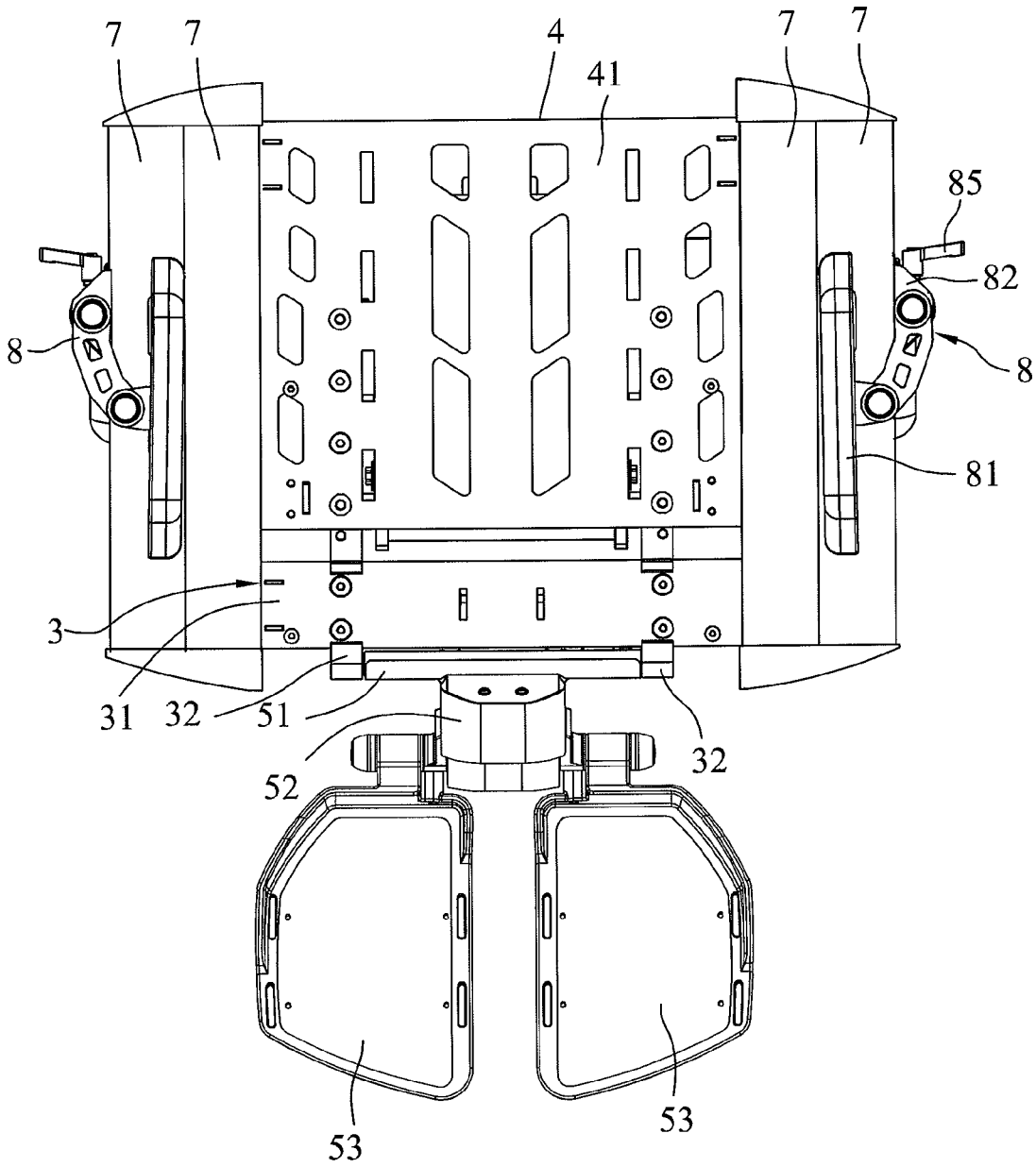
FIG. 10 is a view similar to FIG. 9, but illustrating an alternative form of the first embodiment.
Figure 11:
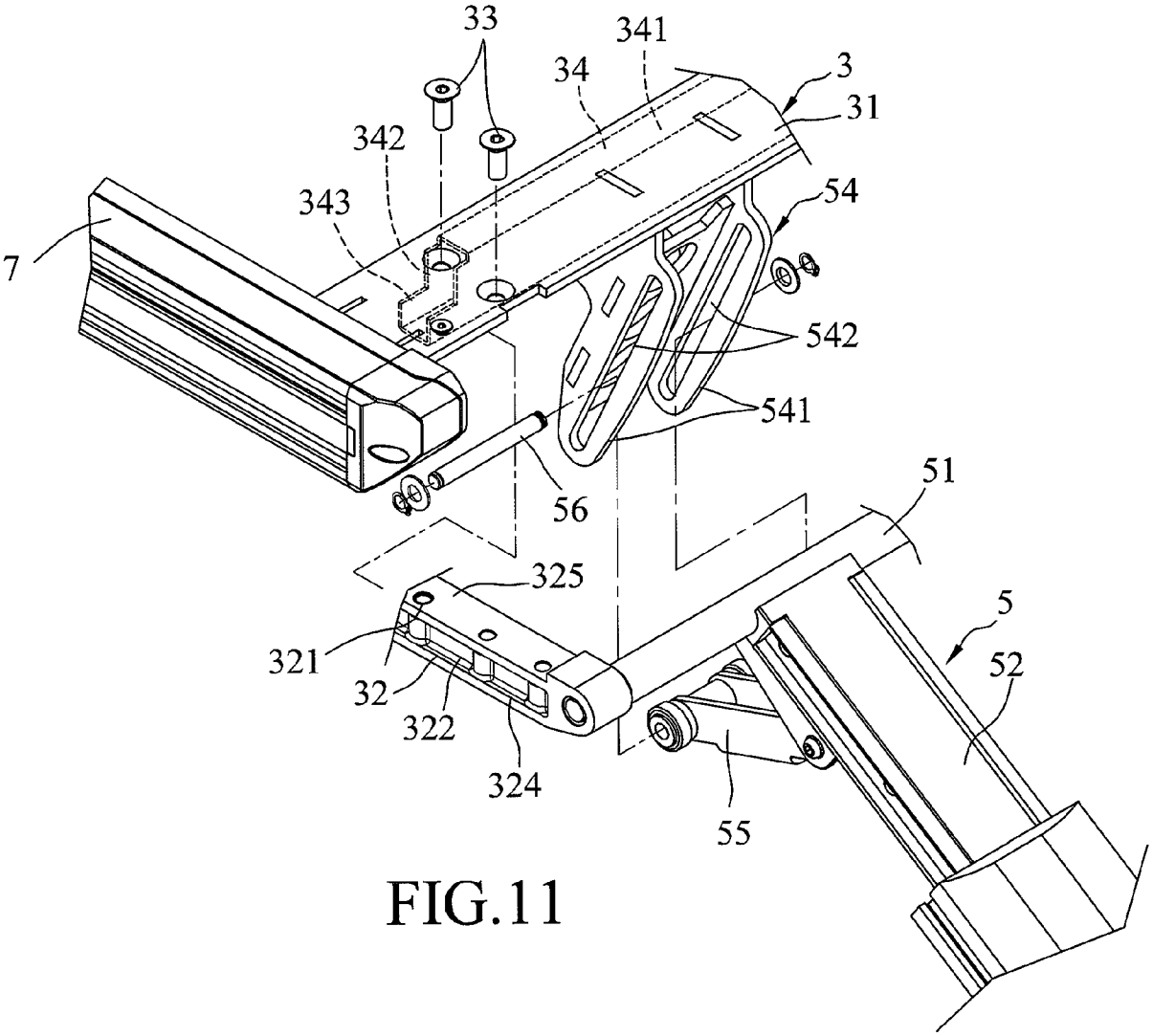
FIG. 11 is a fragmentary exploded perspective view of the right side components of a seat mechanism of an electric wheelchair according to the second embodiment of this invention.
Figure 12:
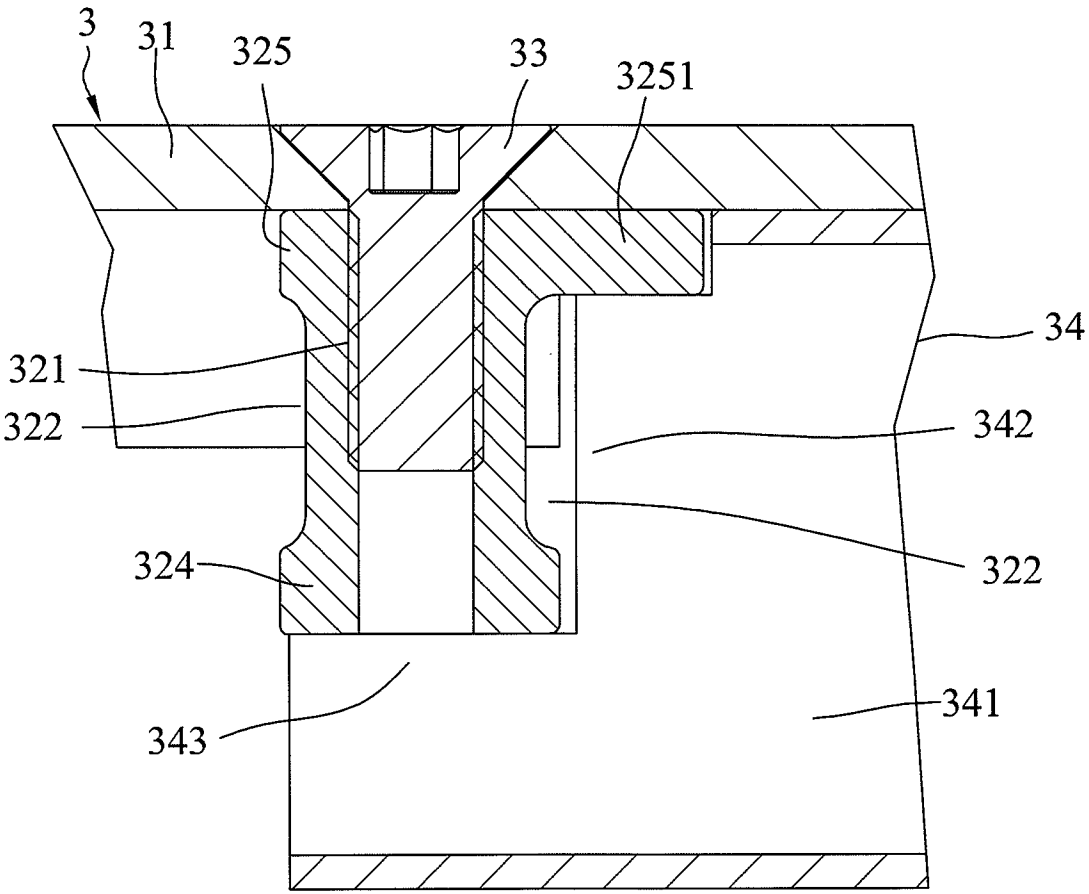
FIG. 12 is a fragmentary front sectional view of the second embodiment.
Figure 13:
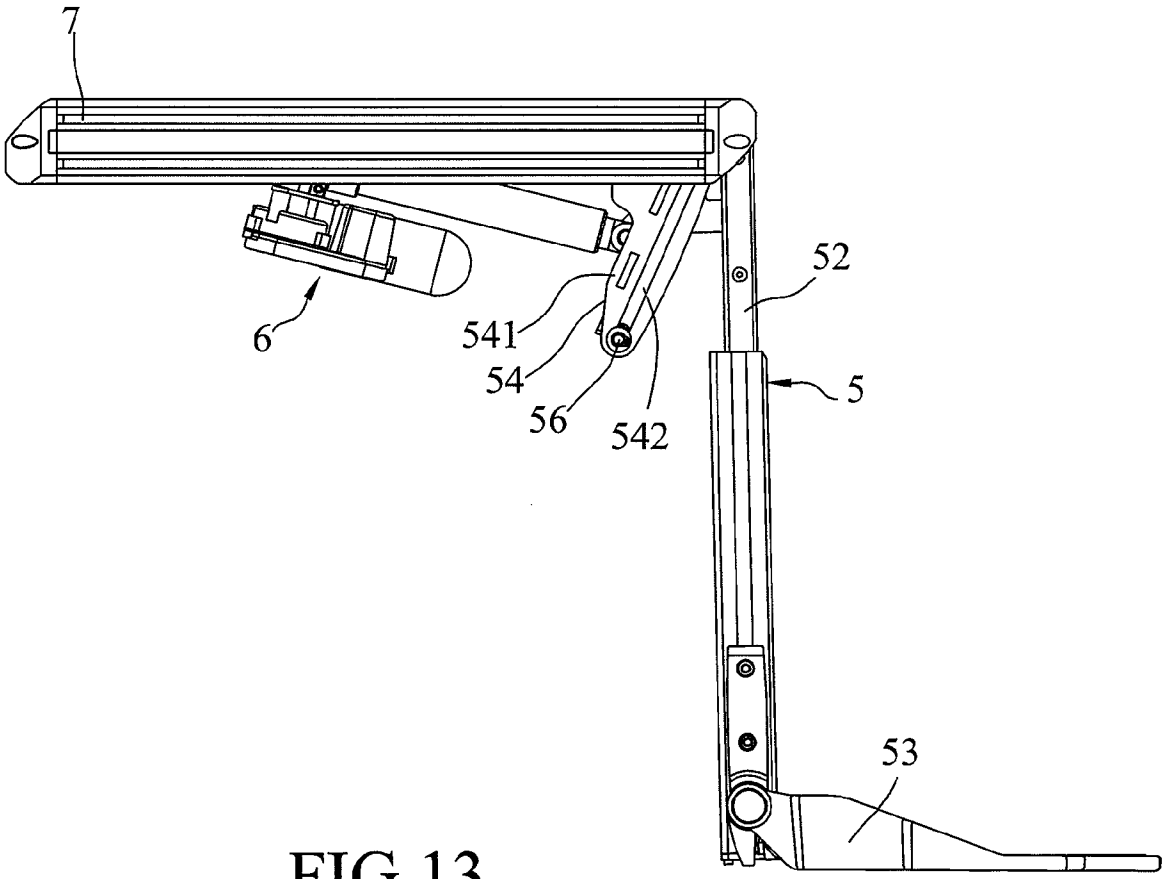
FIG. 13 is a schematic side view of the second embodiment.
Figure 14:
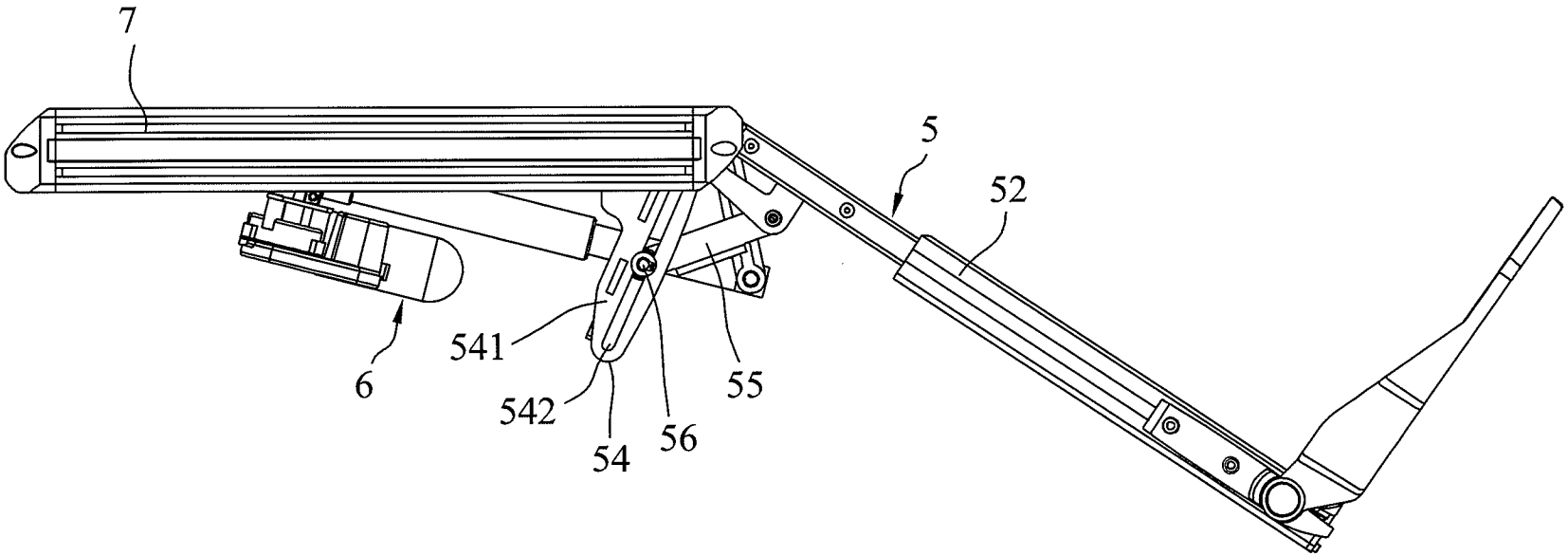
FIG. 14 is a view similar to FIG. 13, but with a footrest unit being moved upward.

Referring to FIG. 10, a plurality of left side bars 7 are mounted to the left sides of the front and rear seat plates 31, 41, and a plurality of right side bars 7 are mounted to the right sides of the front and rear seat plates 31, 41. The left side bars 7 are juxtaposed to each other along the left-right direction and are releasably connectable to each other. The right side bars 7 are also juxtaposed to each other along the left-right direction and are releasably connectable to each other. An innermost one of the left side bars 7 is fixed to the left sides of the front and rear seat plates 31, 41, while an innermost one of the right side bars 7 is fixed to the right sides of the front and rear seat plates 31, 41. The side block units 8 are respectively assembled to an outermost one of the left side bars 7 and an outermost one of the right side bars 7. Only two of each of the left and right side bars 7 are shown in FIG. 10. However, the number of the left or right side bars 7 may be adjusted according to the requirement. An increased number of the left and right sidebars may provide an increased left-to-right width of the seat surface of the seat mechanism. The interconnection of the left side bars 7 or the right side bars 7 may be achieved by providing suitable known connection elements between adjacent left side bars 7 or between adjacent right side bars 7.

Referring to FIGS. 11 to 14, the seat mechanism according to the second embodiment of the present invention is shown to be similar to the first embodiment. The difference between the first and second embodiments resides in the structural design of the front seat plate unit 3 and the footrest unit 5. For convenience of illustration, only the right side components of the seat mechanism will be described hereinafter.

In this embodiment, the front seat plate unit 3 further includes a supporting cross rod 34 fixed to a bottom surface of the front seat plate 31 and extending in the left-right direction. The cross rod 34 has a fixed rod portion 341 fixed to the bottom surface of the front seat plate 31 and disposed between the left and right guide rails 32, two first abutment portions 342 extending outwardly and oppositely from two opposite ends of the fixed rod portion 341 and having top ends lower than a top end of the fixed rod portion 341, and two second abutment portions 343 extending outwardly, oppositely and respectively from the first abutment portions 341 and having top ends lower than the top ends of the first abutment portions 341.

The right guide rail 32 further includes a bottom longitudinal surface 324 opposite to the top longitudinal surface 325. The positioning holes 321 extend through the top and bottom longitudinal surfaces 325, 324. The top longitudinal surface 325 has a protruding portion 3251 protruding therefrom in a direction toward the left guide rail 32. When the right guide rail 32 is assembled on the bottom surface of the front seat plate 31, the bottom longitudinal surface 324 and the protruding portion 3251 of the top longitudinal surface 325 simultaneously abut against the top end of one of the second abutment portions 343 and the top end of the corresponding first abutment portion 342.

The footrest unit 5 further includes a guide seat 54 fixed to the bottom surface of the front seat plate 31, and a link seat 55 pivoted between the guide seat 54 and a top end of the movable bar 52. The guide seat 54 has two spaced-apart parallel panel portions 541. Each of the panel portions 541 extends downwardly, rearwardly and inclinedly from the bottom surface of the front seat plate 31, and has a top end fixed to the bottom surface of the front seat plate 31, and a pin slot 542 extending along the length thereof.

The link seat 55 has a top end pivoted to the top end of the movable bar 52, and a bottom end pivoted to and disposed between the panel portions 541 using an insert pin 56 that is inserted into the pin slots 542 in the panel portions 541 and a through hole in the bottom end of the link seat 55. Through this, the bottom end of the link seat 55 is movable upward and downward along the pin slots 542 of the panel portions 541 through the insert pin 56.

When the movable bar 52 is actuated by the angle adjustment unit 6 to move forward, the movable bar 52 will pull the top end of the link seat 55 to move forward, so that the bottom end of the link seat 55 drives the insert pin 56 to move upward along the pin slots 542. Through the pivot connection of the link seat 55 between the guide seat 54 and the movable bar 52, the movement of the movable bar 52 is more stable. Further, after the movable bar 52 is positioned upward by the angle adjustment unit 6, with the link seat 55 abutting between the guide seat 54 and the movable bar 52, the structural strength of the entire footrest unit 5 can be enhanced, so that the footrest unit 5 will not easily rock or shake.

With the cross rod 34 supporting and abutting against the top ends of the left and right guide rails 32, the structural strength of the entire front seat plate unit 3 can be enhanced. Further, through the structural design of the movable bar 52, the guide seat 54 and the link seat 55 of the footrest unit 5, the stable movement and the structural strength of the entire footrest unit 5 can also be enhanced. Hence, the quality of the seat mechanism of this invention can be relatively improved.

In sum, through the adjustable structure of the front and rear seat plate units 3, 4, and the structure of the side bars 7 which can be detached and replaced, the front-to-rear length and the left-to-right width of the seat surface of the seat mechanism of this invention can be easily adjusted according to the user's requirement. There is no need to remove and replace the entire seat mechanism. Hence, the seat mechanism of this invention is novel. Furthermore, through the structural design of the footrest unit 5 and the angle adjustment unit 6, the pedal position and the angle of placement of the user's feet can also be conveniently adjusted. Moreover, through the structural design of the side block units 8 and the side bars 7, the position of the blocking plates 842 can also be easily adjusted for blocking the user's body. Thus, ease of use of the electric wheelchair having the seat mechanism of this invention can be enhanced. Therefore, the object of the present invention can be realized.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A seat mechanism of an electric wheelchair, comprising:

a front seat plate unit including a front seat plate having front and rear ends that are opposite to each other along a front-rear direction of the electric wheelchair, and left and right guide rails that are elongated in the front-rear direction, that are spaced apart from each other in a left-right direction of the electric wheelchair, that are connected to a bottom surface of said front seat plate, and that extend rearwardly from said rear end of said front seat plate, each of said left and right guide rails having left and right longitudinal surfaces, a top longitudinal surface interconnecting said left and right longitudinal surfaces, a longitudinal rail groove that is indented from at least one of said left and right longitudinal surfaces, and a plurality of positioning holes formed in said top longitudinal surface and longitudinally spaced apart from each other; and a rear seat plate unit including a rear seat plate positioned rearwardly of said rear end of said front seat plate and disposed on said left and right guide rails, two protruding rods each of which protrudes downward from a bottom surface of said rear seat plate to one side of a corresponding one of said left and right guide rails and is elongated in the front-rear direction, a plurality of guide members projecting sideward from each of said protruding rods and longitudinally spaced apart from each other, and a plurality of fasteners each of which extends through said rear seat plate and detachably and selectively engages one of said positioning holes in said left and right guide rails for adjustably positioning said rear seat plate on said left and right guide rails, said guide members of each of said protruding rods being inserted into said rail groove of a corresponding one of said left and right guide rails, such that each of said left and right guide rails straddles and is slidable relative to said guide members of a corresponding one of said protruding rods in the front-rear direction.

2. The seat mechanism as claimed in claim 1, wherein each of said fasteners is threadedly engaged to the selected one of said positioning holes.

3. The seat mechanism as claimed in claim 1, further comprising a footrest unit mounted to and movable along with said front seat plate relative to said rear seat plate, said footrest unit including a cross bar connected rotatably between front ends of said left and right guide rails which are proximate to said front end of said front seat plate, a movable bar fixed to and extending downward from said cross bar, and at least one pedal module mounted to said movable bar.

4. The seat mechanism as claimed in claim 3, wherein said footrest unit further includes a guide seat fixed to said bottom surface of said front seat plate, and a link seat pivoted between said guide seat and said movable bar, said guide seat having at least one panel portion extending downwardly, rearwardly and inclinedly from said bottom surface of said front seat plate, said panel portion having a pin slot extending along the length thereof, said link seat having a top end pivoted to said movable bar, and a bottom end pivoted to said panel portion and slidable upward and downward along said pin slot.

5. The seat mechanism as claimed in claim 3, wherein said movable bar has two slide grooves spaced apart from each other in the left-right direction and extending in a top-bottom direction along the length thereof, said at least one pedal module including two said pedal modules mounted to said movable bar and respectively slidable upward and downward along said slide grooves.

6. The seat mechanism as claimed in claim 5, wherein each of said pedal modules includes a slider disposed in and slidable upward and downward along a respective one of said slide grooves, a mounting seat disposed externally of the respective said slide groove, at least one tightening member connected to said slider and said mounting seat and operable to tighten or loosen said mounting seat against or from the outer side of said movable bar, and a pedal plate pivoted to said mounting seat.

7. The seat mechanism as claimed in claim 3, further comprising an angle adjustment unit mounted between said cross bar and one of said left and right guide rails, said angle adjustment unit including a drive rod fixed to said cross bar, a connecting seat fixed to said one of said left and right guide rails, a telescopic rod pivoted between said drive rod and said connecting seat, and an actuator mounted to said telescopic rod and driving said telescopic rod to extend or shorten the length thereof, said drive rod being driven to rotate said cross bar when said telescopic rod is actuated by said actuator.

8. The seat mechanism as claimed in claim 7, wherein said one of said left and right guide rails has a mounting notch in said top longitudinal surface, said connecting seat being fixed in said mounting notch and being flush with said top longitudinal surface of said one of said left and right guide rails, said connecting seat having top surface formed with a positioning hole for extension of one of said fasteners therethrough.

9. The seat mechanism as claimed in claim 1, further comprising at least one left side bar and at least one right side bar both elongated in the front-rear direction, said at least one left side bar being fixed to left sides of said front and rear seat plates, said at least one right side bar being fixed to right sides of said front and rear seat plates.

10. The seat mechanism as claimed in claim 9, further comprising two side block units respectively mounted to said at least one of said left side bar and said at least one of said right side bar, each of said side block units being movable forward and rearward relative to a respective one of said at least one of said left side bar and said at least one of said right side bar.

11. The seat mechanism as claimed in claim 9, wherein said at least one left side bar includes a plurality of said left side bars that are juxtaposed to each other along the left-right direction and that are releasably connectable to each other, said at least one right side bar including a plurality of said right side bars that are juxtaposed to each other along the left-right direction and that are releasably connectable to each other, an innermost one of said left side bars being fixed to the left sides of said front and rear seat plates, an innermost one of said right side bars being fixed to the right sides of said front and rear seat plates.

12. The seat mechanism as claimed in claim 11, further comprising two side block units respectively mounted to an outermost one of said left side bars and an outermost one of said right side bars, each of said side block units being movable forward and rearward relative to a respective one of said outermost left and right side bars.

13. The seat mechanism as claimed in claim 10, wherein each of said left and right side bars has at least one slide groove indented from an outer surface thereof and extending in the front-rear direction along the length thereof, each of said side block units including a slider disposed in and slidable along said slide groove of a respective one of said left and right side bars, an adapter disposed on an outer surface of the respective one of said left and right side bars, a plurality of fasteners connected to said adapter and said slider and operable to tighten or loosen said adapter against or from the outer side of the respective one of said left and right side bars, and a side block module mounted to said adapter.

14. The seat mechanism as claimed in claim 13, wherein said adapter has an insertion hole extending therethrough in the top-bottom direction, said side block module including a lift rod movably inserted into said insertion hole, and a blocking plate mounted to a top end of said lift rod for blocking a user's body, each of said side block units further including a lever handle that is threadedly connected to said adapter, that extends into said insertion hole in a transverse direction that is transverse to the top-bottom direction, and that is operable to press tightly against said lift rod so as to position said lift rod on said adapter or to move away from said lift rod so as to permit upward and downward movement of said lift rod relative to said adapter.

15. The seat mechanism as claimed in claim 1, wherein said front seat plate unit further includes a supporting cross rod fixed to a bottom surface of said front seat plate and extending in the left-right direction, said left and right guide rails abutting against said supporting cross rod.

16. The seat mechanism as claimed in claim 15, wherein said supporting cross rod has a fixed rod portion fixed to said bottom surface of said front seat plate and disposed between said left and right guide rails, two first abutment portions extending outwardly and oppositely from two opposite ends of said fixed rod portion and having top ends lower than a top end of said fixed rod portion, and two second abutment portions extending outwardly, oppositely and respectively from two opposite ends of said first abutment portions and having top ends lower than the top ends of said first abutment portions, each of said left and right guide rails further having a bottom longitudinal surface abutting against said top end of one of said second abutment portions, said top longitudinal surface having a protruding portion protruding therefrom and abutting against said top end of one of said first abutment portions.

* * * * *